US012097987B2

(12) United States Patent
Lindblad et al.

(10) Patent No.: US 12,097,987 B2
(45) Date of Patent: Sep. 24, 2024

(54) FILLING MACHINE WITH A STERILIZATION STATION

(71) Applicant: TETRA LAVAL HOLDINGS & FINANCE S.A., Pully (CH)

(72) Inventors: Ulf Lindblad, Bjärred (SE); Mårten Regner, Lund (SE); Bo Runnberg, Smedstorp (SE); Jenny Lindblad, Bjärred (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 125 days.

(21) Appl. No.: 17/796,396

(22) PCT Filed: Feb. 8, 2021

(86) PCT No.: PCT/EP2021/052940
§ 371 (c)(1),
(2) Date: Jul. 29, 2022

(87) PCT Pub. No.: WO2021/160550
PCT Pub. Date: Aug. 19, 2021

(65) Prior Publication Data

US 2023/0060701 A1 Mar. 2, 2023

(30) Foreign Application Priority Data

Feb. 14, 2020 (EP) ..... 20157433

(51) Int. Cl.
*B65B 55/10* (2006.01)
*B65B 3/02* (2006.01)
*B65B 55/02* (2006.01)

(52) U.S. Cl.
CPC ..... *B65B 55/10* (2013.01); *B65B 3/025* (2013.01); *B65B 55/025* (2013.01)

(58) Field of Classification Search
CPC ..... B65B 55/10; B65B 3/025; B65B 55/025
See application file for complete search history.

(56) References Cited

U.S. PATENT DOCUMENTS 3,566,575 A * 3/1971 Lisiecki ..... B65B 55/10 53/167
6,039,922 A * 3/2000 Swank ..... B65B 55/04 53/425

(Continued)

FOREIGN PATENT DOCUMENTS

EP 0460380 A1 12/1991
WO 2007036492 A1 4/2007

OTHER PUBLICATIONS

International Search Report (PCT/ISA/210) and Written Opinion (PCT/ISA/237) mailed on May 3, 2021, by the European Patent Office as the International Searching Authority for International Application No. PCT/EP2021/052940.

*Primary Examiner* — Andrew M Tecco
*Assistant Examiner* — Nicholas E Igbokwe
(74) *Attorney, Agent, or Firm* — BUCHANAN INGERSOLL & ROONEY PC

(57) ABSTRACT

A filling machine configured to form, fill, and seal individual packages is provided. The filling machine comprises a sterilization station configured to provide a flow of gaseous sterilizing agent towards open ends of ready-to-fill packaging containers passing through said sterilization station. The filling machine comprises at least one clean air supply and at least one baffle plate arranged above the at least one clean air supply, wherein the air supply is configured to direct a stream of clean air towards the ready-to-fill packaging containers. The clean air supply in turn comprises at least one distribution pipe and wherein the distribution pipe (Continued)

extends in a horizontal direction, the horizontal direction being in the direction of the flow of packages through the filling machine.

20 Claims, 4 Drawing Sheets

(56) References Cited

U.S. PATENT DOCUMENTS

| | | | | |
|---|---|---|---|---|
| 6,120,730 | A * | 9/2000 | Palaniappan | B65B 55/10 53/167 |
| 2006/0008383 | A1* | 1/2006 | Moller | B65B 55/025 422/62 |
| 2010/0021359 | A1* | 1/2010 | Auer | B65B 55/025 422/291 |
| 2012/0085370 | A1* | 4/2012 | Auer | B65B 55/10 134/61 |
| 2017/0327259 | A1* | 11/2017 | Linnestad | B67C 7/0086 |

* cited by examiner

FILLING MACHINE WITH A STERILIZATION STATION

TECHNICAL FIELD

The invention relates to a filling machine, in particular to a filling machine being configured to form, fill, and seal individual packages. The present invention also relates to a method for such filling machine.

BACKGROUND ART

Within the food industry, beverages and other products are often packed in paper or paperboard-based packages. Packages intended for liquid food are often produced from a packaging laminate comprising a core layer of paper or paperboard and an outer, liquid-tight layer of thermoplastic material on at least the side of the core layer which will form the inside of the packages.

One type of frequently occurring packages are so-called ready-to-fill packages. Such a ready-to-fill package is provided as a sleeve of packaging laminate like the one described above, being sealed at its bottom end prior to filling. The upper end may be formed by either by forming and sealing the upper end of the sleeve or by producing an upper part in the form of e.g. a polymer top; the upper end/part may be provided with an opening/closing means, such as a screw cap.

Another type of package, which also can be used with the invention described herein, is produced in an upside-down configuration, being sealed at the top portion (which is arranged downwards) and having the bottom portion open for filling. Typically, the downwardly directed top portion is produced as a polymer top.

Independently of the type of package being produced, the open-ended packaging material sleeve is received at an infeed station of the filling machine, whereafter one end of the sleeve is sealed; the semi-finished package has at this point a shape which is ready to fill. However, further processes are required to provide a hygienic packaging. At a downstream station, the open sleeves are sterilized at least on the inside in order to extend the shelf-life of the product to be stored in the packages. Depending on the desired shelf-life and depending on whether the packages are to be distributed and stored in a refrigerated environment or at room temperature, different levels of sterilization may be obtained. Sterilization is performed using a gaseous sterilization agent, such as H2O2.

After sterilization of the packages, they are further transported to a filling zone for product filling, a sealing zone for sealing of the open end, and typically also to a final forming zone for final forming of the package.

Transportation of the packages is achieved by a sequence of carriers being guided along a conveying path. The conveying path is preferably continuous through the filling machine, such that a stream of packages is moving through the filling machine and all required stations.

After sterilization of the ready-to-fill packages it is important to maintain hygienic conditions as the packages are filled and sealed by subsequent stations. Hence, these filling machine stations are installed in a hygienic zone in order to ensure minimum re-contamination of the already sterilized packages.

In the above described machine, the transport system for the ready-to-fill packages inside the hygienic chamber is kept at relatively cold temperature due to i) the cold environment in the hygienic chamber and ii) due to the lubrication of the transport system by cooling water.

During the sterilization process, the dew point of the H2O2 gas needs to be very high to secure condensation of the H2O2 on the entire inside surface of the ready-to-fill package. The high dew point of the gas will, as a consequence, also cause a significant amount of condensed H2O2 on the transport system as well as onto the exterior surfaces of the packages.

The condensed H2O2 on the transport system and on the exterior surfaces of the packages will then be transported through the filling machine. As the condensed film is slowly evaporating along the movement around the entire transport system, emissions of H2O2 will occur from the filling machine openings; from the infeed opening where the blanks are fed into the filling machine and from the outfeed opening, where the formed, filled, and sealed packages are fed out from the machine.

Furthermore, this will result in significant concentration of H2O2 in the entire filling machine, also in areas where machine components may be present that are not specifically designed to be compatible with H2O2 exposure. This will possibly result in e.g. corrosion or reduced lifetime of such components.

Another problem is associated with machine downtime. During machine stops, access to the filling machine should preferably not be allowed until the H2O2 has been evaporated and ventilated out, causing delay times.

In view of the above disadvantages associated with the use of a sterilization agent, such as a gaseous agent like H2O2, there is a need for reducing condensation of H2O2 on the transport system and on the exterior surfaces of the packages during the sterilization process, while still maintaining a controlled and sufficiently high concentration of sterilization agent inside the package.

SUMMARY

It is an object of the invention to at least partly overcome one or more of the above-identified limitations of the prior art. In particular, it is an object provide a filling machine being capable of ensuring a required sterilization of ready-to-fill packages, while reducing undesired condensation and evaporation of gaseous sterilizing agent.

To solve these objects a filling machine is provided. The filling machine is configured to form, fill, and seal individual packages whereby the filling machine comprises a sterilization station configured to provide a flow of gaseous sterilizing agent towards open ends of ready-to-fill packaging containers passing through said sterilization station. The filling machine further comprises at least one clean air supply arranged at a vertical position below said open ends of the ready-to-fill packaging containers and configured to direct a stream of clean air, preferably filtered or sterile air, towards the ready-to-fill packaging containers. Preferably, the clean air supply extends in the machine direction across the position of one or more supplies of the gaseous sterilizing agent.

The clean air supply may comprise at least one distribution pipe whereby the clean air can be distributed in an effective manner.

The distribution pipe may extend in a horizontal direction, the horizontal direction being in the direction of the flow of packages through the filling machine.

The distribution pipe may be provided with a plurality of outlet holes distributed in the longitudinal direction of the distribution pipe. The outlet holes may be directed upwards and inwards, towards the ready-to-fill packaging container.

The filling machine may further comprise at least one baffle plate arranged vertically above the at least one clean air supply. The baffle plate, which preferably is arranged horizontally, is advantageous in that several jets of clean air are merged to a planar jet. The baffle plate also provides for a physical separation of the gas environment, above the baffle plate, from the clean air environment, below the baffle plate, to avoid mixing of the two. Hence, dilution of the gas above the baffle plate is avoided and consequently it is possible to sustain a high concentration of gas around the gas jets, i.e. the gas supplies, such that the jets and thus the gas in the packages is not diluted. Something of this is described in line 14-17 on side 6 but the plate is key here.

Further, the clean air jets are directed towards the baffle plate to achieve a so called "wall attachment", whereby a wall jet is created. These wall jets will act as rectangular jet like structures on the baffle plate thereby protecting the opening surface between the baffle plates. This protection of the opening surface will reduce the flow of gas from the gas supply nozzles in the vertical direction and will thereby direct more gas flow in the horizontal direction towards the downstream holding section, thereby assisting in sustaining the packages in a gas environment.

The small flow of gas that is directed vertically between the baffle plates has proven to be more concentrated to the center plane whereby the flow around the larger part of the surface of the package carriers is thus diluted by the clean airflow to avoid a high concentration of gas at these areas.

The filling machine may comprise a first distribution pipe arranged on one side of the ready-to-fill package, and a second distribution pipe arranged on the opposite side of the ready-to-fill package.

The clean air supply may be configured to provide a planar jet of clean air towards the ready-to-fill package, preferably by means of the baffle plate.

The filling machine may comprise a plurality of index positions for supplying a gaseous sterilizing agent to a plurality of ready-to-fill packages, wherein the clean air supply, in the form of one or more distribution pipes, extend across said index positions.

The clean air supply may be connected to an air supply system for a downstream ventilation means.

According to a second aspect, a method for sterilizing a ready to-fill package is provided. The method comprises a first step of supplying a gaseous sterilization agent towards the interior of the ready-to-fill package, and a second step of providing a flow of clean air, preferably filtered and/or sterile air, towards the exterior surface of the ready-to-fill package.

The step of providing the flow of clean air towards the exterior surface of the ready-to-fill package may comprise directing a plurality of clean air jets towards a baffle plate in order to provide a planar jet of clean air.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
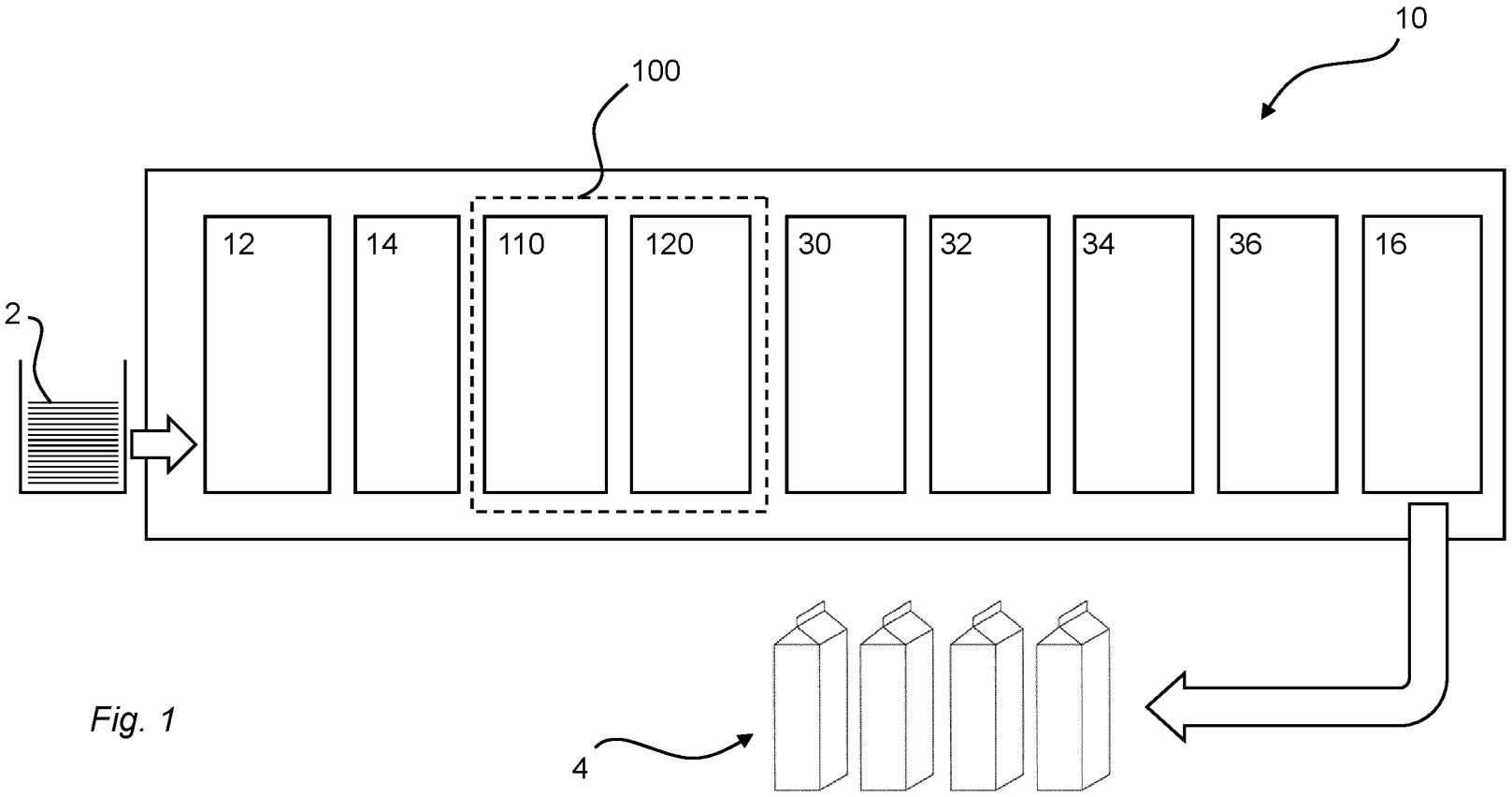
FIG. 1 is a schematic view of a filling machine according to an embodiment.

With reference to FIG. 1 a filling machine 10 is shown schematically. Although the filling machine described in the following text is configured to produce carton-based packages by closing a bottom end of a tube of packaging material, and finally closing its upper end after sterilization and filling, the filling machine 10 could also be configured to produce other types of packages, e.g. the plastic top packages briefly described in the background section of this application.

The filling machine 10, being configured to form, fill, and seal packages 4, has an infeed station 12 in which blanks 2 of packaging material are received. The blanks 2 are typically produced as sleeves of carton-based packaging material, as is well known in the art and already described briefly in the background section. The infeed station 12 is arranged upstream a bottom sealing station 14, in which the blanks 2 are erected to a tube shape where in the bottom sealing station 14 the bottom end of each blank is sealed to form a semi-finished package having one closed and sealed bottom end being, while the upper end of the package is still open.

The semi-finished packages are transported to a sterilization station 100, in which the amount of living microorganisms is reduced. As explained in the background section, the level of sterilization may vary depending on user objectives. Sterilization of the packaging material is accomplished by means of treatment with a gaseous sterilizing agent, preferably H2O2 (hydrogen peroxide).

The sterilization station 100 comprises an upstream supply station 110, providing a flow of the gaseous sterilizing agent. A venting station 120 is arranged downstream the supply station 110.

A hygienic chamber is provided downstream the sterilization station 100. The hygienic chamber comprises further stations of the filling machine. Immediately downstream the sterilization station 100 a filling station 30 is arranged. Here, the ready-to-fill packages are filled with the desired product content. After filling, the packages may be transported to a pre-folding station 32 in which the upper part of the open-ended package is formed to a desired shape. After pre-forming the packages are transported to a heating station 34 in which heat-sealable material of the packaging material is heated to an elevated temperature. The elevated temperature of the upper end of the packages facilitates sealing of the upper end when the packages enter the sealing station 36 arranged immediately after the heating station 34.

Once sealed, the packages 4 no longer require hygienic conditions when they exit the hygienic chamber. At the end of the filling machine 10, an outfeed station 16 is arranged which is configured to discharge the finished packages 4 from the filling machine 10 to downstream equipment, storage, and/or transport.

Figure 2:
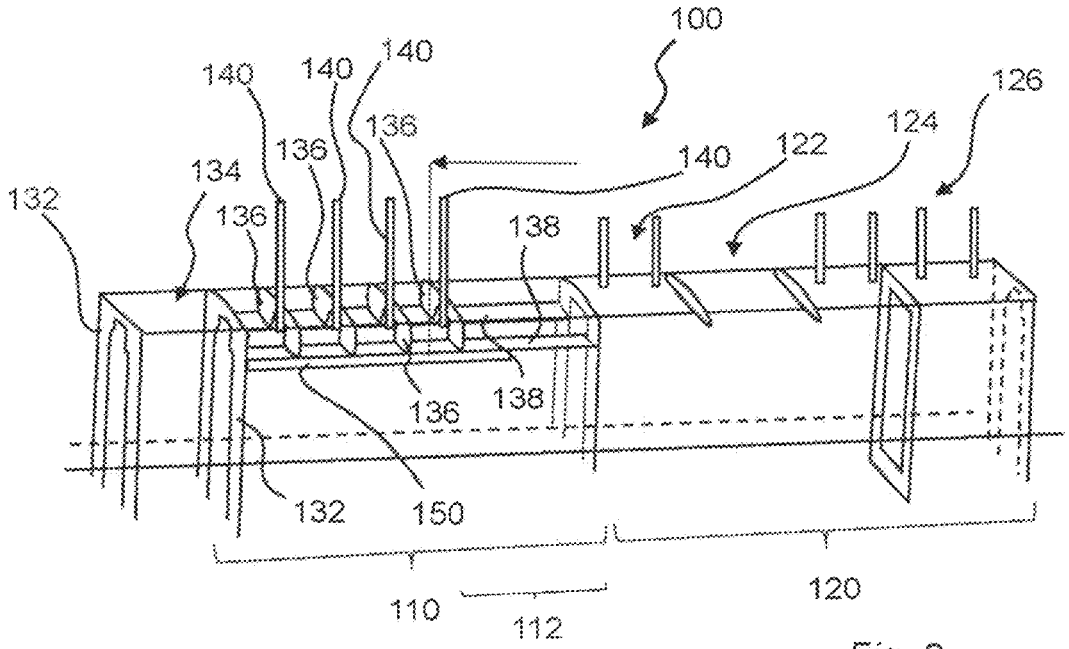
FIG. 2 is a schematic isometric view of a sterilization station forming part of a filling machine according to an embodiment.

The sterilization station 100 is further shown in FIG. 2. As can be seen, the sterilization station 100 has the shape of a tunnel. Ready-to-fill packages (not shown) are fed into the sterilization station 100 from the left-hand side of the drawing. The ready-to-fill packages are transported by a conveyor comprising a plurality of consecutive cassettes; each cassette is carrying a ready-to-fill package. For illustrative purposes, the conveyor, as well as the cassettes and the packaging containers carried therein, are not shown (although these machine components can be seen in FIG. 3).

Conveyors of this type, including the cassettes, are well known in the art and will not be described further herein.

As can be seen in FIG. 2, the sterilization station 100 is provided with a plurality of baffle plates 132. Two vertical baffle plates 132 are provided at the inlet side of the sterilization unit 100, extending from the bottom portion of the tunnel to the upper portion of the tunnel. The baffle plates 132 are separated in the machine direction, and the space formed between these baffle plates 132 acts as an entry section 134 of the sterilization station 100.

Downstream the entry section 134, the supply section 110 is arranged. The purpose of the supply section 110 is to provide a flow of gaseous sterilizing agent, preferably H2O2, such that the interior, as well as the exterior, of the ready-to-fill packages is sterilized. As mentioned earlier in the background section, the dew point of the H2O2 gas secures condensation of H2O2 on the inside surface of the ready-to-fill package.

The sterilization station 100, and in particular the supply section 110, is preferably provided as a continuous tunnel where an atmosphere of high and relatively uniform concentration of gaseous sterilizing agent is created in the vertically upper gassing portion in order to establish a controlled and even gas distribution into the packages to obtain the required sterilization effect. As is explained in the following, this is achieved without causing massive condensation on the conveyor at the vertically lower portion.

Vertical baffle plates 136 are provided at the upper portion of the supply section 110. The baffle plates 136 of the supply section 110 extend upwards from horizontally arranged baffle plates 138. The horizontal baffle plates 138 are spaced apart such that cassettes and ready-to-fill packages can pass between the horizontal baffle plates 138.

The vertical baffle plates 136 of the supply section 110 divide the space inside the tunnel in four distinct index positions. In a preferred embodiment each index position is associated with a gas supply tube 140, preferably arranged at the longitudinal position of the vertical baffle plates 136. Hence, four ready-to-fill packages can be positioned at the index positions at the same time, whereby the gas supply tubes 140 are activated to supply the gaseous sterilizing agent towards the interior of the ready-to-fill packages. However, in some embodiments one or more of the gas supply tubes 140 can be replaced by e.g. a gas holding station, meaning no gas supply at these positions. In order to reduce the amount of sterilizing agent on the conveyor, distribution pipes 150 are provided. These distribution pipes 150 will be further described with reference to FIG. 3.

Again referring to FIG. 2, immediately downstream the index positions there is a holding section 112; here, the condensation is allowed to build up for a certain amount of time.

In another embodiment H2O2 is used as a sterilizing agent, in combination with a UV light source arranged at a downstream holding section 112. The initial gas concentration can thereby be lower in this variant, e.g. 3% H2O2 compared to 35% H2O2, but as the dew point of the gas is a lot higher, the amount of condensation will increase considerably compared to the 35% H2O2 case.

The venting station 120 is arranged downstream the holding section 112 with the purpose of evaporating all sterilizing agent from the ready-to-fill packages.

Figure 3:
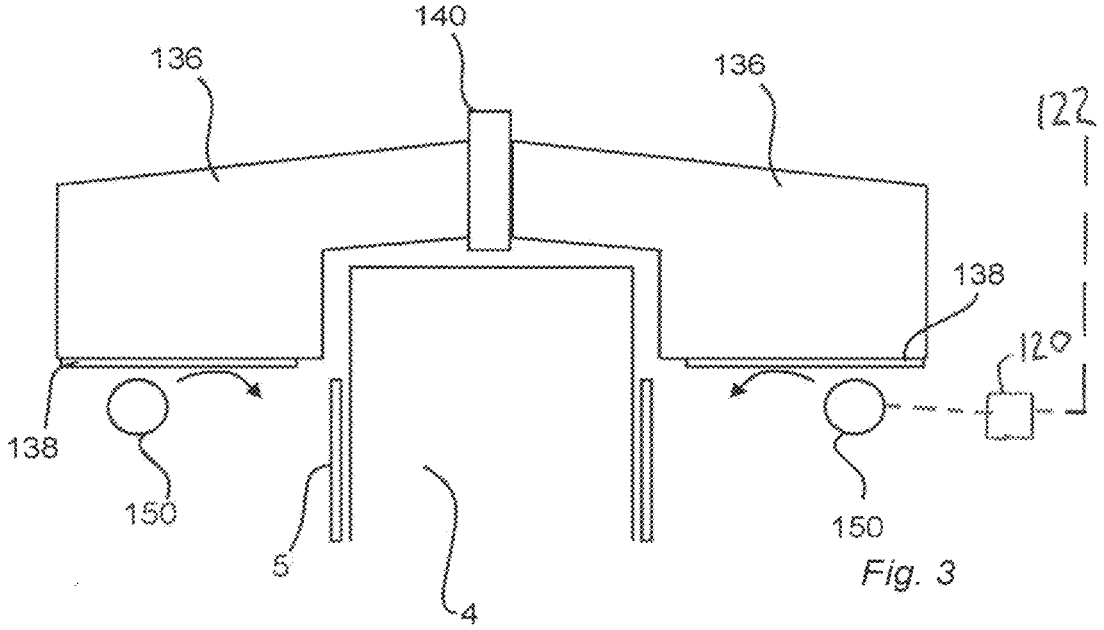
FIG. 3 is a cross-sectional view of a sterilization station forming part of a filling machine according to an embodiment.

Now turning to FIG. 3, a cross-section of the supply section 110 is shown. The ready-to-fill package 4 is carried by the cassette 5, which extends almost along the entire vertical extension of the ready-to-fill package 4. The cassette 5 is in turn driven by a conveyor (not shown), which is connected to the bottom portion of the cassette 5.

The gas supply tube 140 is directed downwards, thereby allowing sterilizing agent to enter the ready-to-fill package 4 such that the interior is sterilized. Some amount of sterilizing agent will also condense on the outer surface of the package 4, as well as on the cassette. The distribution pipes 150, which are arranged on each side of the cassette 5 and extend in the horizontal direction, i.e. in the direction of the flow of packages through the filling machine, assist in reducing the amount of sterilizing agent on the cassette 5 and on the conveyor. The distribution pipes 150 form a clean air supply, which is extending horizontally at a vertical position below the open ends of the ready-to-fill packaging containers and configured to direct a stream of clean air, preferably filtered and/or sterile air, towards the packaging containers.

The idea is to introduce two distribution pipes 150 for the clean air supply, one on each side of the conveyor/cassette 5 extending in the horizontal direction and placed slightly below the horizontal baffle plates 138 in the vertical direction, i.e. in the direction orthogonal to the flow of packages through the filling machine. These distribution pipes 150 are designed with a row of outlet holes 152 (see FIG. 4). The distance between a distribution pipe 150 and the associated baffle plate 138 arranged vertically above the distribution pipe 150 is in the range of 2-100 mm.

The distribution pipes 150 extend along the index positions, such that four cassettes 5 can be exposed to clean air at the same time.

Figure 4:
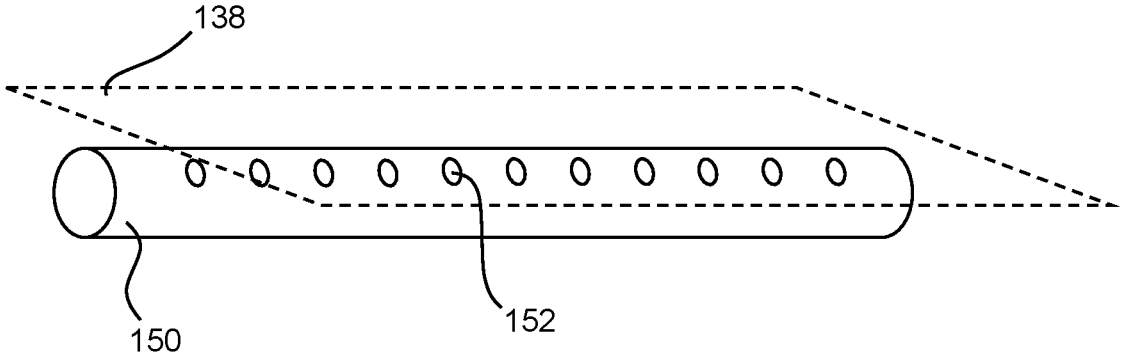
FIG. 4 is a schematic isometric view of a distribution pipe forming part of a filling machine according to an embodiment.

Further details of the distribution pipe 150 is shown in FIG. 4. Typical dimensions of the outlet holes 152 may comprise a diameter of 4 mm and a center-to-center distance of 12 mm, although other dimensions could be considered as well.

The outlet holes 152 are placed at an angle towards the horizontal baffle plate 138 (see FIG. 3), which will create a planar jet along the package movement direction, towards the conveyor and package outside surfaces, as indicated by the arrows in FIG. 3. This planar jet of clean air will reduce the concentration of sterilizing agent, such as H202, near the conveyor and the exterior surfaces of the ready-to-fill packaging container without affecting the uniform and high concentration of gas above the horizontal baffle plates 138.

The introduced airflow can be quite small, as the inlet air jets will entrain air from the lower part of the tunnel of the supply section 110 thereby enhancing the gas dilution effect further. This also means that the velocities of the created planar air jet will be quite small, so that the high and controlled concentration can be maintained in the upper portion of the supply section 110.

The supply of the clean air for the distribution pipes 150 could preferably be integrated with the air supply system for the ventilation means or ventilation system 122. An example of this is schematically illustrated in FIG. 3, which schematically depicts an air supply system 120. If the branching is made after a heater connected to the air supply system, two benefits are obtained. First of all, as the clean air is relatively warm it will also contribute to heating of the horizontal baffle plates 138 and further enhancing the evaporation of the condense film on the cassette 5 as well as on the exterior surface of the packaging container 4. This will assist in improving the robustness of the system and also to maintain the hygienic conditions inside the piping system.

Figure 5:
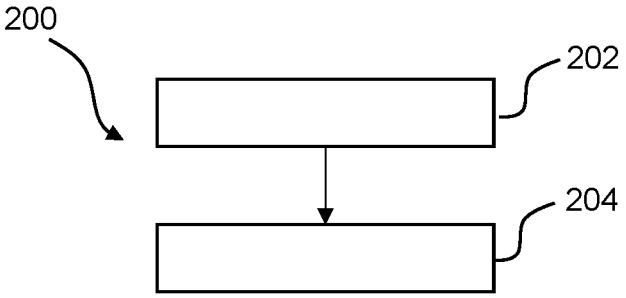
FIG. 5 is a schematic view of a method according to an embodiment.

Now turning to FIG. 5 a method 200 for sterilizing a ready-to-fill package 4 is schematically illustrated. The method 200 comprises a first step 202 of supplying a gaseous sterilization agent towards the interior of the ready-to-fill package, and a second step 204 of providing a flow of clean air towards the exterior surface of the ready-to-fill package 4. Preferably, the step 204 of providing the flow of clean air towards the exterior surface of the ready-to-fill package 4 comprises directing a plurality of clean air jets towards a baffle plate 138 in order to provide a planar jet of clean air.

Figure 6A:
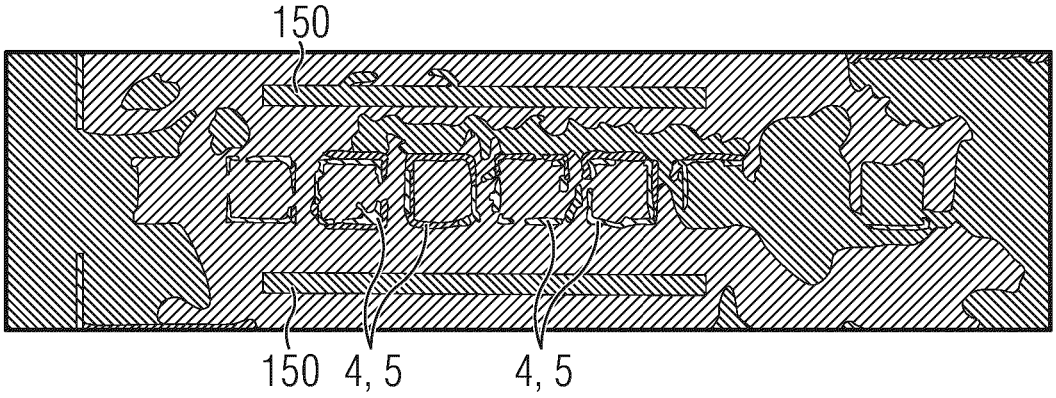
FIGS. 6*a-c* are simulation graphs of a sterilization station forming part of a filling machine according to an embodiment during operation.
Figure 6B:
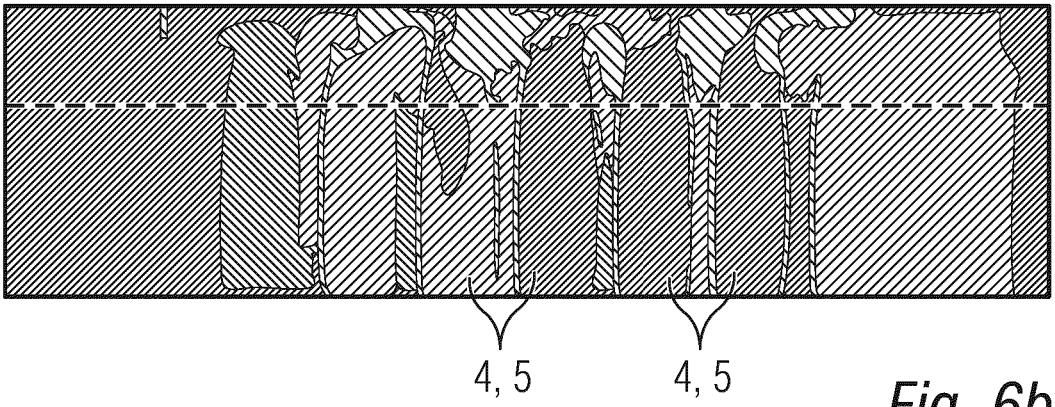
Figure 6C:
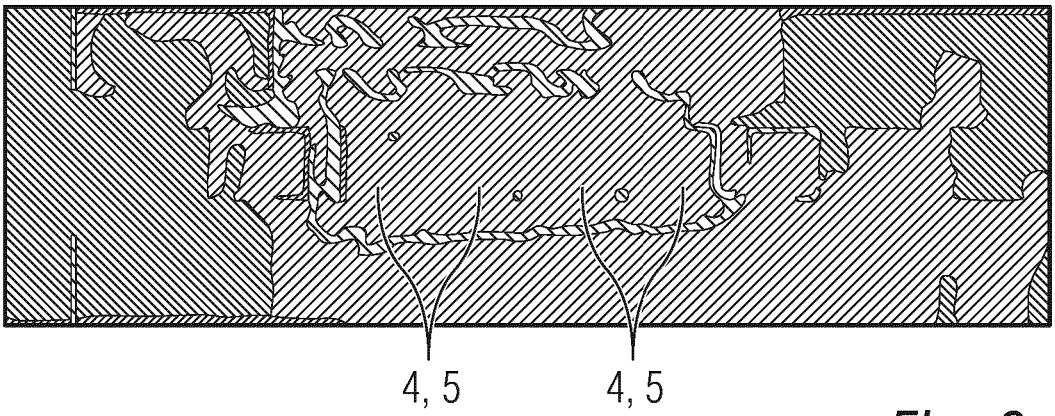

Now turning to FIGS. 6*a-c* the filling machine 10 is illustrated during a simulation in which a gaseous sterilizing agent, in this case H2O2, is supplied towards the open ends of a series of ready-to-fill packages 4. Each ready-to-fill package 4 is carried by a cassette 5 as described above. As can be seen in FIG. 6*a*, sterilization occurs at four index positions.

FIG. 6*a* illustrates that the sterilizing agent is concentrated inside the ready-to-fill packages 4, as compared to the simulation of FIG. 6*c* where the sterilizing agent leaks and is distributed all around the ready-to-fill packages 4. The difference between the filling machine 10 of FIG. 6*a* and the machine of FIG. 6*c* is that in FIG. 6*a*, there is a clean air supply in the form of two distribution pipes 150 providing jets of clean air towards the ready-to-fill packages 4.

In FIG. 6*b* the filling machine 10 of FIG. 6*a* is shown in cross-section, further illustrating the effect of the distribution pipes 150.

From the description above follows that, although various embodiments of the invention have been described and shown, the invention is not restricted thereto, but may also be embodied in other ways within the scope of the subject-matter defined in the following claims.

The invention claimed is:

1. A filling machine configured to form, fill, and seal individual packages, comprising a sterilization station configured to provide a flow of gaseous sterilizing agent towards open ends of ready-to-fill packaging containers passing through said sterilization station, the filling machine further comprising:

a conveyor that conveys the ready-to-fill packaging containers through said sterilization station;

at least one clean air supply and at least one baffle plate arranged above the at least one clean air supply, wherein the air supply is configured to direct a stream of clean air towards the ready-to-fill packaging containers;

the conveyor being movable relative to the baffle plate; and wherein the clean air supply comprises at least one distribution pipe and wherein the distribution pipe extends in a horizontal direction, the horizontal direction being in the direction of the flow of packages through the filling machine.

2. The filling machine according to claim 1, wherein the distribution pipe is provided with a plurality of outlet holes distributed in the longitudinal direction of the distribution pipe.

3. The filling machine according to claim 2, wherein the outlet holes are directed upwards and inwards, towards the ready-to-fill packaging container.

4. The filling machine according to claim 1, comprising a first distribution pipe arranged on one side of the ready-to-fill package, and a second distribution pipe arranged on the opposite side of the ready-to-fill package.

5. The filling machine according to claim 1, wherein the clean air supply is configured to provide a planar jet of clean air towards the ready-to-fill package.

6. The filling machine according to claim 1, comprising a plurality of index positions for supplying a gaseous sterilizing agent to a plurality of ready-to-fill packages, wherein the clean air supply, in the form of one or more distribution pipes, extend across said index positions.

7. The filling machine according to claim 1, wherein the clean air supply is connected to an air supply system for a downstream ventilation system.

8. The filling machine according to claim 1, wherein the at least one distribution pipe comprises two distribution pipes extending in the horizontal direction and spaced apart from each other in a direction transverse to the direction of flow.

9. The filling machine according to claim 1, wherein the at least one baffle plate comprises two horizontal baffle plates spaced apart from one another in a direction transverse to the direction of flow of the ready-to-fill packages, both of the horizontal baffle plates being arranged above the at least one clean air supply.

10. The filling machine according to claim 9, further comprising a gas supply tube for supplying the gaseous sterilizing agent, the gas supply tube being located between the two horizontal baffle plates as seen in a cross-sectional view transverse to the direction of flow of the ready-to-fill packages.

11. A method for sterilizing a ready-to-fill package having an open upper end, comprising supplying a gaseous sterilization agent towards the interior of the ready-to-fill package as the ready-to-fill package is being conveyed in a direction of flow, and providing a flow of clean air towards an exterior surface of the ready-to-fill package, wherein providing the flow of clean air towards the exterior surface of the ready-to-fill package comprises directing a plurality of clean air jets towards a baffle plate in order to provide a planar jet of clean air, the ready-to-fill package moving relative to the baffle plate while the plurality of clean air jets are directed towards the baffle plate, the open upper end of the ready-to-fill package being located above the baffle plate while the plurality of clean air jets are directed towards the baffle plate.

12. The method according to claim 11, wherein the directing of the plurality of clean air jets towards the baffle plate comprises directing the plurality of clean air jets towards two horizontal baffle plates that are spaced apart from one another, the ready-to-fill package being conveyed between the two horizontal baffle plates, with open ends of the ready-to-fill packaging containers being positioned above the two horizontal baffle plates.

13. The method according to claim 12, wherein the supplying of the gaseous sterilization agent towards the interior of the ready-to-fill package comprises supplying the gaseous sterilization agent towards the interior of the ready-to-fill package by way of a gas supply tube located between the two horizontal baffle plates as seen in a cross-sectional view transverse to the direction of flow.

14. The method according to claim 12, wherein the clean air jets are directed towards each of the two horizontal baffle plates by way of respective distribution tubes that are spaced apart from one another and horizontally arranged, the ready-to-fill package being conveyed between the two spaced apart distribution tubes.

15. A filling machine configured to form, fill, and seal individual packages, the filling machine comprising:

a movable conveyor configured to convey ready-to-fill packaging containers with open ends through the interior of the sterilization station in a direction of flow so that a flow of gaseous sterilizing agent introduced into the interior of the sterilization station while the ready-to-fill packaging containers are conveyed through the interior of the sterilization station is directed towards the open ends of the ready-to-fill packaging containers;

two baffle plates spaced apart from one another in a direction transverse to the direction of flow so that the baffle plates are positioned on opposite sides of the ready-to-fill packaging containers passing through the interior of the sterilization station during operation of the filling machine, each of the baffle plates extending in a horizontal direction, the horizontal direction being the direction of flow of packages through the filling machine; and at least one clean air distribution tube provided with a plurality of through holes to direct a stream of clean air towards at least one of the horizontal baffle plates and ultimately the ready-to-fill packaging containers, the at least one clean air distribution tube extending in a horizontal direction, the horizontal direction being in the direction of flow of the ready-to-fill packaging containers, the two baffle plates being arranged above the at least one clean air distribution tube.

16. The filling machine according to claim 15, wherein the conveyor is movable relative to the two baffle plates and relative to the at least one clean air distribution tube so that the ready-to-fill packaging containers being moved through the interior of the sterilization station by the conveyor are moved relative to the two baffle plates and relative to the at least one clean air distribution tube.

17. The filling machine according to claim 15, wherein the at least one clean air distribution tube comprises two clean air distribution tubes spaced apart from one another in the direction transverse to the direction of flow, each of the clean air distribution tubes being positioned adjacent a respective one of the baffle plates, each of the clean air distribution tubes including a plurality of through holes to direct a stream of clean air towards the respective one of the baffle plates, each of the baffle plates being arranged above the respective clean air distribution tube.

18. The filling machine according to claim 15, further comprising a gas supply tube in communication with the interior of the sterilization station and configured to supply the gaseous sterilizing agent, the gas supply tube being located between the two baffle plates as seen in a cross-sectional view transverse to the direction of flow of the ready-to-fill packages.

19. The filling machine according to claim 15, further comprising a cassette that carries the ready-to-fill packaging containers through the interior of the sterilization station, the cassette being connected to the conveyor.

20. The filling machine according to claim 15, further comprising at least three vertical baffle plates spaced apart from one another in the direction of flow of the ready-to-fill packages to divide the interior of a supply section of the sterilization station into plural distinct index positions at each of which is positionable one of the ready-to-fill packaging containers for sterilization, and further comprising a plurality of gas supply inlets each in communication with a respective one of the index positions and configured to supply the gaseous sterilizing agent to the ready-to-fill packaging container located at the respective index position.

* * * * *